US010336517B1

(12) United States Patent
Laible

(10) Patent No.: US 10,336,517 B1
(45) Date of Patent: Jul. 2, 2019

(54) TAMPER-PROOF CONTAINER INSERT

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 17 days.

(21) Appl. No.: 15/864,385

(22) Filed: Jan. 8, 2018

(51) Int. Cl.

| | |
|---|---|
| ***B65D 39/00*** | (2006.01) |
| ***B65D 49/12*** | (2006.01) |
| ***B65D 51/16*** | (2006.01) |
| ***B65D 55/02*** | (2006.01) |

(52) U.S. Cl.
CPC ..... *B65D 55/02* (2013.01); *B65D 39/0052* (2013.01); *B65D 49/12* (2013.01); *B65D 51/16* (2013.01)

(58) Field of Classification Search
CPC .... B65D 55/02; B65D 39/0052; B65D 51/16; B65D 55/165; B65D 7/06; B65D 47/36; B65D 49/00; B65D 49/12; B65D 39/025; B65D 43/0254; B65D 43/0272
USPC ..... 222/481.5
See application file for complete search history.

(56) References Cited

U.S. PATENT DOCUMENTS

| | | | | |
|---|---|---|---|---|
| 3,604,582 | A * | 9/1971 | Boudin | B65D 50/06 215/202 |
| 5,988,456 | A | 11/1999 | Laible | |
| 6,142,345 | A | 11/2000 | Laible | |
| 6,296,136 | B1 * | 10/2001 | Huet | B62D 25/24 138/89 |
| 6,968,983 | B2 * | 11/2005 | Laible | B67D 7/0294 222/464.1 |
| 9,126,725 | B1 * | 9/2015 | Laible | B65D 25/50 |
| 9,242,847 | B1 * | 1/2016 | Laible | B67D 7/0294 |
| 2006/0076307 | A1 * | 4/2006 | Chung | B65D 49/00 215/21 |
| 2014/0138274 | A1 * | 5/2014 | Smith | B65D 49/00 206/459.1 |

* cited by examiner

*Primary Examiner* — Benjamin R Shaw
(74) *Attorney, Agent, or Firm* — Dennis L. Thomte; Thomte Patent Law Office LLC

(57) ABSTRACT

A tamper-proof insert for use with a liquid container. The insert is of the foam liner venting type. The insert is designed to be inserted into the throat of a container such as a bottle. A retention lug ring is secured to the lower end of the insert. The retention lug ring includes a plurality of spaced-apart retention lugs, having upper and lower ends, which extend upwardly and outwardly from a base ring. The upper ends of the retention lugs of the retention lug ring engage the inside surface of the container to prevent the insert from being manually pulled upwardly and outwardly from the throat of the container. If the insert is pulled from the container against the resistance of the retention lugs, the lugs will break-away from the insert and it will be evident that the insert has been subjected to tampering.

6 Claims, 4 Drawing Sheets

TAMPER-PROOF CONTAINER INSERT

BACKGROUND OF THE INVENTION

Field of the Invention

This invention relates to a tamper-proof container insert which is press-fitted into the throat of a container which has liquid therein. More particularly, the container insert is of the foam liner venting type. Even more particularly, this invention relates to a retention lug ring which is secured to the lower end of the insert with the retention lug ring including a plurality of radially spaced-apart retention lugs which extend upwardly and outwardly therefrom and which engage the inside surface of the container to prevent the insert from being pulled upwardly and outwardly from the container. Even more particularly, the retention lugs will break-away from the retention lug ring if the insert is forcefully pulled from the container with the broken lugs being evidence that the insert has been subjected to tampering.

Description of the Related Art

Container inserts are used in closed loop systems in many systems such as disclosed in U.S. Pat. Nos. 5,958,456; 6,142,345; 6,968,983; 9,126,725; and 9,242,847. Although the inserts of the above-identified patents work extremely well, it is believed that the container inserts should be tamper-proof by making the inserts extremely difficult, if not impossible, to be removed from the container. If the inserts are not tamper-proof, the inserts could be removed from the container so that the insert and container could be re-used, which is illegal in some jurisdictions.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A tamper-proof container insert is described which is press-fitted into the throat of a container which has liquid therein. The insert is of the foam liner venting type. The foam liner of the insert enables the interior of the container to be vented when the valve thereof is opened or closed. A horizontally disposed retention lug ring is mounted on the insert at the lower end thereof. The retention lug ring includes a horizontally disposed base ring which is secured to the insert at the lower end of the insert. The retention lug ring has a plurality of radially spaced-apart retention lugs, having upper and lower ends, which extend upwardly and outwardly from the base ring whereby the upper ends of the retention lugs are in engagement with the inside surface of the container which makes it difficult, if not impossible, for the insert to be removed from the container thereby preventing the container or insert from being re-used.

It is therefore a principal object of the invention to provide an improved tamper-proof foam liner venting insert.

A further object of the invention is to provide a tamper-proof insert for a container.

A further object of the invention is to provide an insert for use with a container with the insert having a retention lug ring mounted thereon at the lower end thereof, with the lugs of the retention lug ring engaging the inner surface of the container to make it difficult, if not impossible, to remove the insert from the container.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
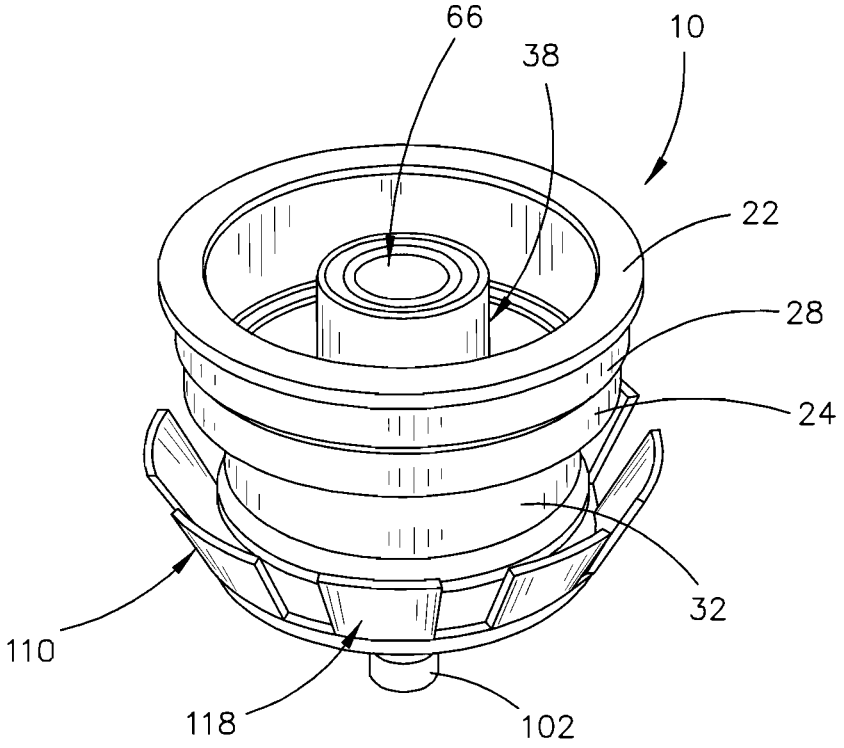
FIG. 1 is an upper perspective view of the tamper-proof container insert of this invention.
Figure 2:
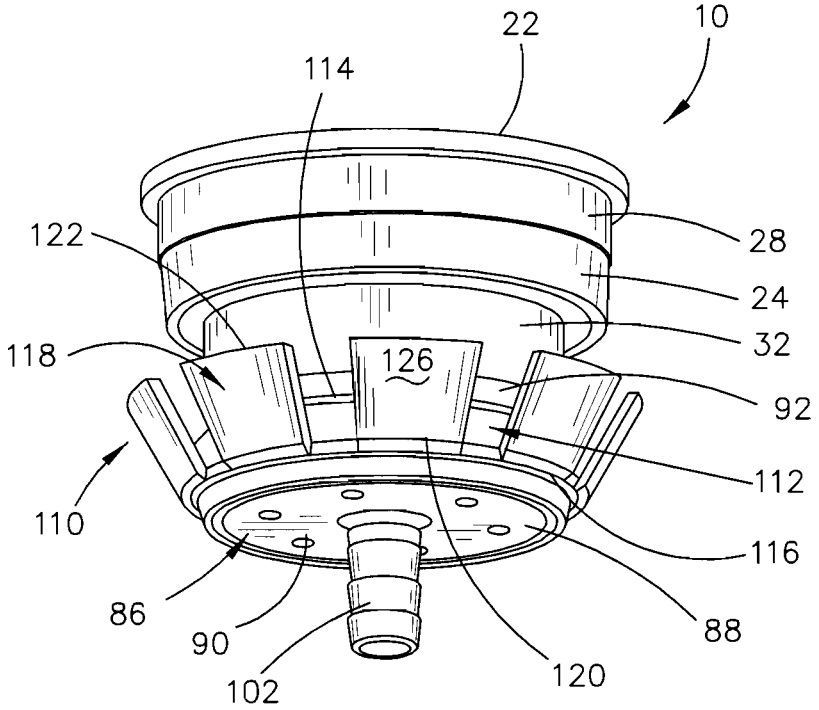
FIG. 2 is a lower perspective view of the tamper-proof container insert of this invention.
Figure 3:
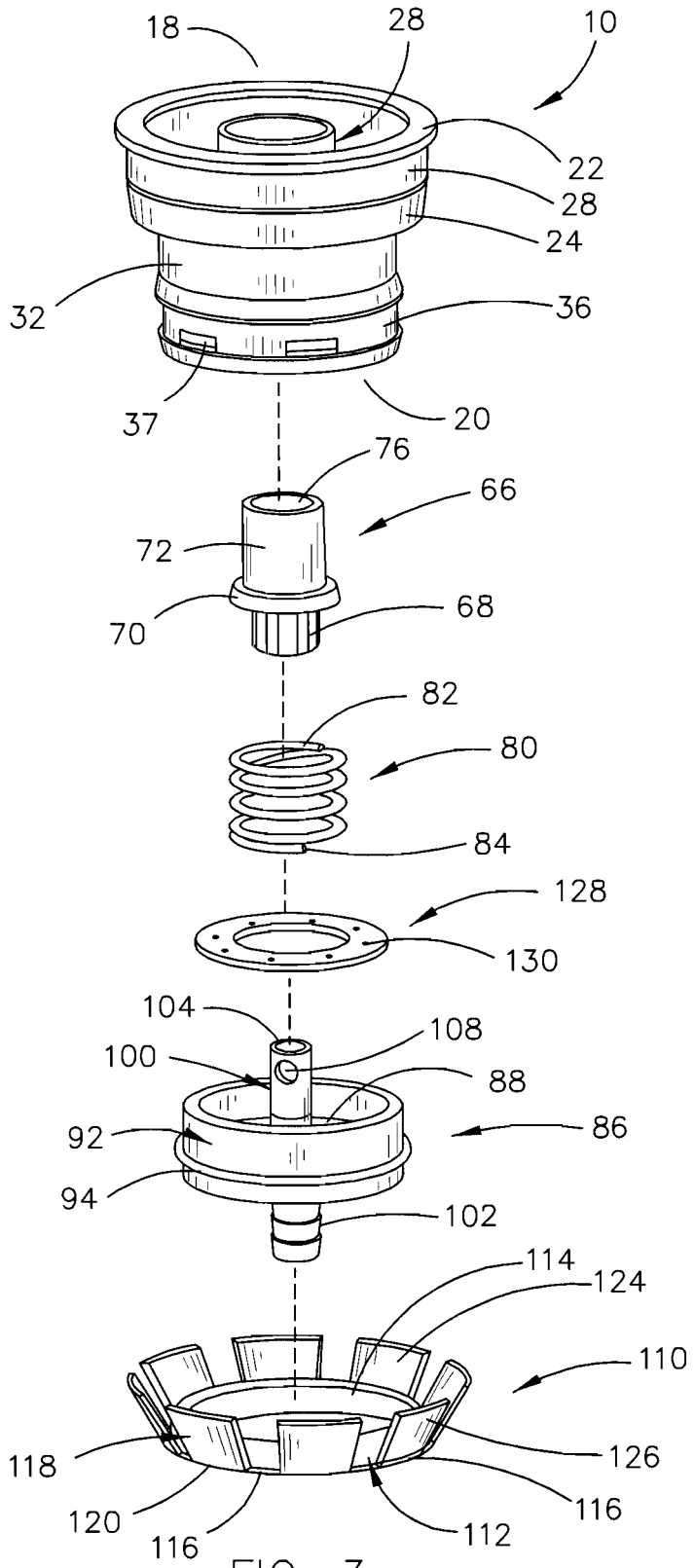
FIG. 3 is an exploded perspective view of the tamper-proof container insert of this invention.
Figure 4:
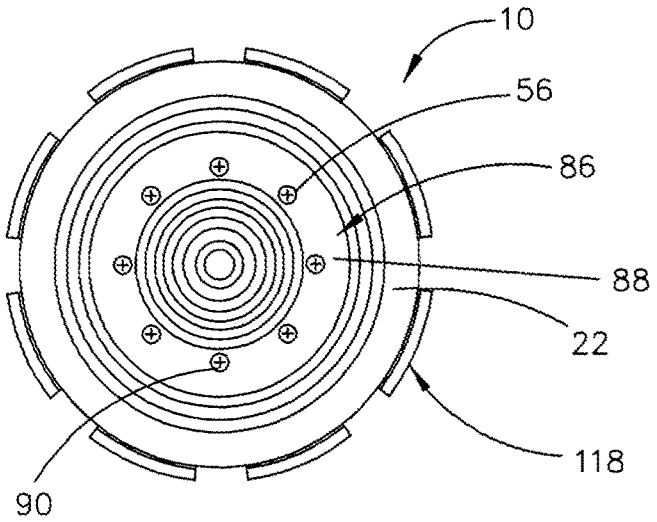
FIG. 4 is a top view of the tamper-proof container insert of this invention.
Figure 5:
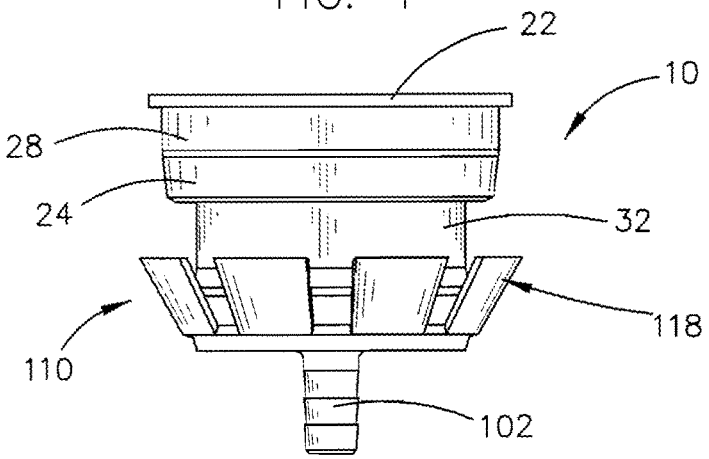
FIG. 5 is a side view of the tamper-proof container insert of this invention.
Figure 6:
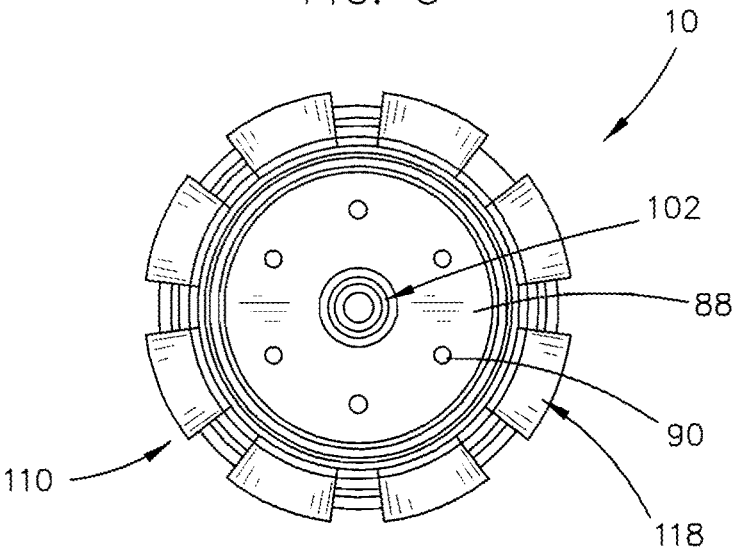
FIG. 6 is a bottom view of the tamper-proof container insert of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a container insert or throat plug assembly (hereinafter "insert") which is press-fitted into the throat or outlet opening 12 of a container 14 such as a bottle or the like. Preferably, throat opening 12 has external threads 16. Insert 10 includes an open upper end 18 and an open lower end 20. Insert 10 includes a ring-shaped upper flange or lip 22, and a first cylindrical wall member 24, which extends downwardly from the inner end of lip 22. The outer surface of wall member 24 has a cylindrical recess 26 formed therein. A seal 28 is positioned in recess 26 as shown and described in U.S. Pat. Nos. 9,242,847 and 9,126,925, the disclosures of which are incorporated herein by reference thereto to complete this disclosure if necessary.

The lower end of wall member 24 has an inwardly extending lower end, lip or shoulder 30. Wall member 32 extends downwardly from the inner end of shoulder 30 and has a lower end 34. A ring-shaped, annular recess 36 is formed in wall member 32 at the lower end thereof, the purpose of which will described hereinafter. A plurality of radially spaced-apart openings 37 are formed in recess 36.

Insert 10 has a receiver portion 38 integrally molded therein which includes a cylindrical wall or tubular portion 40 having an upper end 42 and a lower end 44. A ring-shaped and horizontally disposed wall or shoulder 46 extends inwardly and outwardly from the lower end 44 of tubular portion 40 to define a chamber 48 thereabove. Cylindrical wall 50, having a lower end 51, extends downwardly from the outer end of wall 46 to define a chamber 52. Wall 50 is joined to wall 32 by an annular shoulder 54 which has a plurality of vent openings 56 formed therein. A ring-shaped groove 58 is formed in the lower ends of walls 32 and 50 which extends upwardly thereinto.

An annular chamber or recess 62 is formed between walls 32 and 50 at the lower end of wall 50 which is in communication with the vent openings 56. As seen, the lower end 64 of the inner portion of wall 32 terminates above the lower end 34 of the outer portion of the wall 32. As seen, the lower end 64 of the inner portion of wall 32 dwells in the same plane as the lower end 51 of wall 50.

The numeral 66 refers to a valve stem or valve which includes a lower tubular member 68, an annular shoulder portion 70, and a cylindrical upper tubular member 72. As seen, the diameter of bore 74 of lower tubular member 68 is less than the diameter of the bore 76 of upper tubular member 72. Annular shoulder portion 70 preferably has an annular groove or recess 78 formed in the lower side thereof.

Figure 7:
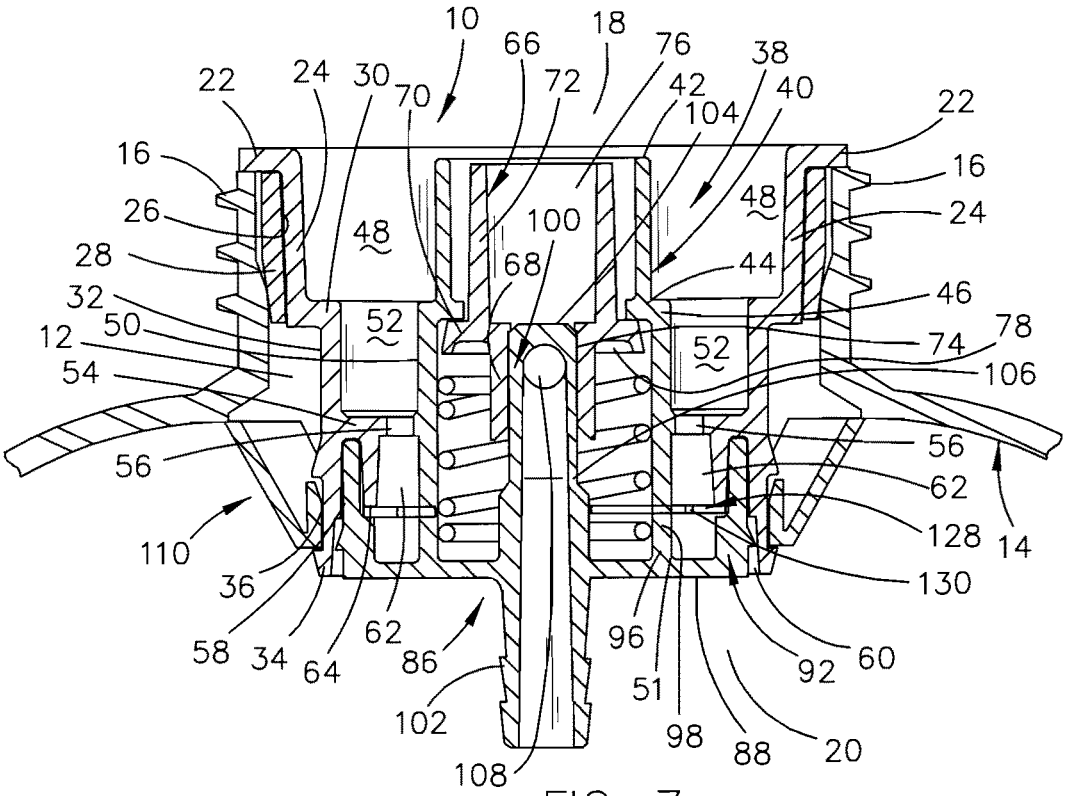
FIG. 7 is a sectional view of the tamper-proof container insert of this invention with the container insert being positioned in the throat of a container and with the valve of the container insert being in a closed upper position to prevent liquid from flowing outwardly through the container insert while enabling the container to be vented.
Figure 8:
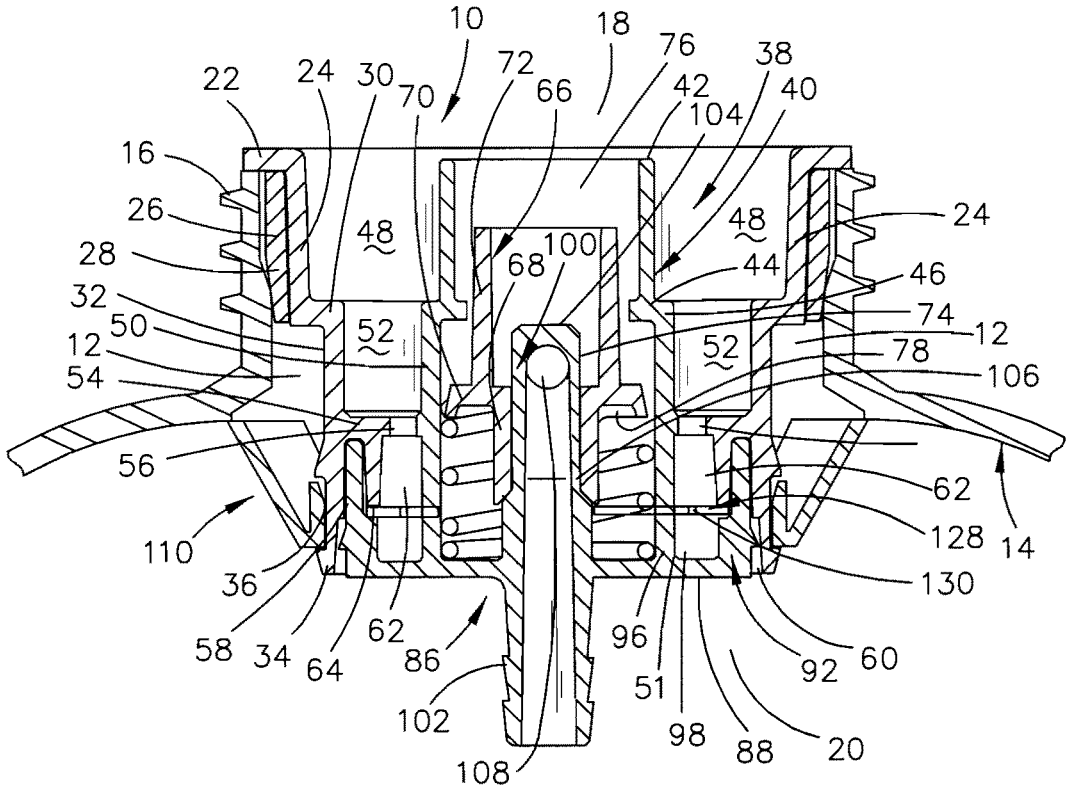
FIG. 8 is a view similar to FIG. 7 except that the valve thereof is opened to permit liquid to flow outwardly from the container therethrough and to permit air to enter the container as liquid is drawn from the container.

As seen in the drawings, valve 66 is vertically movably received in receiver portion 38. As will be explained hereinbelow, valve 66 is movable between an upper position (FIG. 7) to a lower position (FIG. 8). As seen, when valve 66 is in its upper position of FIG. 7, the upper end of tubular member 72 is positioned slightly below the upper end 42 of tubular member 40.

The numeral 80 refers to an elongated spring having an upper end 82 and a lower end 84. As seen, the upper end of spring 80 is received in the groove 78 formed in the underside of shoulder portion 70.

The numeral 86 refers to a disc member or retainer having a horizontally disposed bottom wall 88 having a plurality of vent openings 90 formed therein. A ring-shaped side wall 92 extends upwardly from the periphery of bottom wall 88. The outer surface of side wall 92 has an annular rib 94 extending outwardly therefrom.

A circular or cylindrical support wall 96 extends upwardly from bottom wall 86 inwardly of wall 92 and which has an upper end 98. The numeral 100 refers to a hollow valve body which is integrally formed with retainer 86 and which is in communication with the hollow and elongated dip tube support 102 which extends downwardly from the bottom wall 88. Valve body 100 includes a closed upper end 104 and an open lower end 106. The upper end of valve body 104 is closed as seen in the drawings. The side wall of valve body 100 has a pair of openings 108 formed therein to permit the liquid being drawn from the container 14, through the dip support 102, to pass upwardly through the valve body 100 as will be described hereinafter.

The spring 80 is positioned between the annular shoulder 70 of the retainer 86. The retainer 86 is then snap-fitted onto the lower end of tubular portion 40 by inserting the side wall 97 into the groove 58. The retainer 86 is further held in the groove 58 by the rib 94 engaging the inner side of the lower end of tubular portion 40. The spring 80 yieldably maintains the valve 66 in its upper position so that the openings 108 in valve body 100 are closed.

The numeral 110 refers to a retention lug ring which includes a horizontally disposed base ring member 112 having an upper end 114 and a lower end 116. Retention lug ring 110 also includes a plurality of radially spaced-apart lugs or flaps 118, each of which have a lower end 120, an upper end 122, an inner side 124 and an outer side 126. The lower ends 120 of lugs 118 are molded to the lower end of base ring member 112 and extend upwardly and outwardly therefrom.

The retention lug ring 110, which is comprised of a plastic material, is secured to the insert whereby the base ring member 112 is received in the recess 36 of wall member 32. When the insert 10 is positioned in the throat 12 of container 14, the upper ends 122 of lugs 118 engage the inner surface of container 14 as seen in FIGS. 7 and 8. The retention lug ring 110 resists any upward movement of the insert 10 with respect to the container 14 thereby making it extremely difficult, if not impossible, to remove the insert 10 from the container 14. Thus, the insert 10 is tamper-proof. When the insert 10 is mounted in the throat 12 of the container 14, the spring 80 will yieldably maintain the valve 66 in its upper position of FIG. 7. In the upper position of FIG. 7, the openings 108 in valve body 100 will be closed. In the upper position of valve 66, venting of the container 14 is possible, as will be described hereinafter.

When liquid in the container 14 is to be withdrawn, the valve 66 will be moved downwardly to the lower position of FIG. 8 by structure such as disclosed in the above-identified patents. When valve 66 is in its lower position of FIG. 8, the openings 108 in valve body 100 will be open so that liquid may be drawn upwardly through the dip tube mounted on dip tube support 102, through valve body 100 into bore 70 of upper tubular member 64 and outwardly therefrom.

When the valve 66 is in its open position, air may be supplied to the interior of container 14 to replace the liquid being withdrawn from the container. When the valve 66 is in its upper closed position of FIG. 7, the interior of container 14 may be vented by the vent opening 90 in bottom wall 88, the lower end of chamber 62, the perforation 130 in foam liner 128, vent openings 56, chamber 52 and chamber 48.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination with a container having an upper end with an inside surface and a throat with an inside surface, comprising:

a tamper-proof insert positioned in the throat of the container with the insert having upper and lower ends;

said insert being of the foam liner venting type;

a horizontally disposed retention lug ring mounted on said insert at said lower end of said insert;

said retention lug ring including a horizontally disposed base ring which is secured to said insert at said lower end of said insert; and said retention lug ring having a plurality of radially spaced-apart retention lugs, having upper and lower ends, which extend upwardly and outwardly from said base ring whereby said upper ends of said retention lugs are in engagement with the inside surface of the container to prevent said insert from being removed from the container.

2. A tamper-proof insert for use with a closed loop dispensing system including a container having a throat with an inside surface, comprising:

a horizontally disposed ring-shaped lip having an upper side, a lower side, an outer end, and an inner end;

a generally cylindrical first wall member having an open upper end, an open lower end, an inner surface and an outer surface;

said first wall member extending downwardly from said inner end of said lip whereby said lip protrudes outwardly form said upper end of said first wall member;

a generally horizontally disposed first annular shoulder extending inwardly from said open lower end of said first wall member;

said first annular shoulder having an inner end, an outer end, an upper end and a lower end;

a generally vertically disposed and annular second wall member having an upper end and a lower end;

said second wall member extending downwardly from said inner end of said first annular shoulder;

a vertically disposed tubular receiver having an upper end, a lower end, an inner surface and an outer surface;

a generally horizontally disposed and annular third wall member having an inner end, an outer end, an upper side and a lower side;

said lower end of said tubular receiver being secured to said third wall member outwardly of said inner end of said third wall member to define a valve stop at said inner end of said third wall member;

an annular fifth wall member which is horizontally disposed and which has inner and outer ends;

said inner end of said fifth wall member being secured to said fourth wall member above said lower end of said fourth wall member;

said outer end of said fifth wall member being secured to said second wall member above said lower end of said second wall member;

said fifth wall member having a plurality of radially spaced-apart vent openings formed therein;

a vertically disposed and annular sixth wall member having upper and lower ends;

said upper end of said sixth wall member being secured to said fifth wall member;

said sixth wall member being spaced inwardly of said second wall member to form a vertically disposed groove therebetween;

said lip, said first wall member, said first annular shoulder, said tubular receiver, said fourth wall member, said fifth wall member and said sixth wall member being integrally formed;

an upstanding hollow valve body having an upper tubular member, a lower tubular member, and a horizontally disposed annular shoulder portion extending outwardly between said upper and lower tubular members;

said upper tubular member having a greater diameter than said lower tubular member;

said annular shoulder portion of said valve body having an upper side and a lower side;

said upper tubular member being vertically movably received in said tubular receiver so as to be movable between an upper position and a lower position;

said upper side of said annular shoulder portion of said valve body being in sealing engagement with said third wall member when said valve body is in said upper position;

said upper side of said annular shoulder portion of said valve body being spaced from said third wall member when said valve body is in said lower position;

a cylindrical spring having an upper end and a lower end;

said upper end of said spring embracing said lower tubular member of said valve body;

said upper end of said spring being in engagement with said lower side of said annular shoulder portion of said valve body;

a retainer member having a horizontally disposed circular bottom wall having a plurality of spaced-apart vent openings formed therein;

said bottom wall having upper and lower sides;

a ring-shaped first side wall, having a lower end, an upper end, an outer surface and an inner surface, extending upwardly from said bottom wall;

said outer surface of said ring-shaped first side wall having a horizontally disposed annular rib extending outwardly therefrom;

said inner surface of said ring-shaped first side wall having a shoulder formed therein;

a ring-shaped support wall, having upper and lower ends, extending upwardly from said bottom wall inwardly of said ring-shaped first side wall;

an elongated hollow valve body, having a closed upper end and a open lower end, integrally formed with said bottom wall and extending upwardly therefrom;

said hollow valve body member having a plurality of openings formed therein below said upper end thereof;

a hollow dip tube support, having upper and lower ends, extending downwardly from said lower end of said hollow valve body member and being in fluid communication with open lower end of said hollow valve body member;

said upper end of said first side wall of said retainer member being received in said vertically disposed groove formed between fifth and sixth wall members whereby said upper side of said bottom wall of said retainer is in engagement with said lower end of said spring;

a horizontally disposed and ring-shaped foam liner having an upper side and a lower side;

said foam liner having spaced-apart perforations formed therein;

said foam liner being positioned at said lower ends of said fourth and sixth wall members so as to be supported on said shoulder formed on said inner surface of said first side wall of said retainer and said upper end of said support wall with said perforations of said foam liner being positioned between said inner surface of said first side wall and support wall;

said insert preventing fluid flow from said container when said valve body is in said upper position;

said insert permitting fluid flow from said container when said valve body is in said lower position;

said insert permitting ambient air to pass therethrough into said container when said valve body is in said lower position;

said foam liner permitting air or gas to pass therethrough while preventing liquid to pass therethrough whereby the container is vented at all times;

and a locking ring secured to said second wall member which engages the inside surface of said container to prevent said insert from being removed from said container.

3. The tamper-proof insert of claim 2 wherein said locking ring is a retention lug ring.

4. The tamper-proof insert of claim 2 wherein said outer side of said second wall member has an annular recess formed therein at said lower end of said second wall and wherein said locking ring is positioned in said annular recess.

5. The tamper-proof insert of claim 4 wherein said locking ring includes a base ring which is received in said annular recess and wherein a plurality of flexible lugs extend upwardly and outwardly from said base ring in a radially spaced-apart manner for engagement with the inside surface of said container.

6. The tamper-proof insert of claim 5 wherein said locking ring is comprised of a plastic material.

* * * * *